US011105155B2

(12) United States Patent
Ren et al.

(10) Patent No.: US 11,105,155 B2
(45) Date of Patent: Aug. 31, 2021

(54) ROTARY STEERABLE DRILLING SYSTEM AND METHOD WITH IMBALANCED FORCE CONTROL

(71) Applicant: General Electric Company, Schenectady, NY (US)

(72) Inventors: Zhiguo Ren, Shanghai (CN); Xu Fu, Shanghai (CN); Chengbao Wang, Oklahoma City, OK (US); Stewart Blake Brazil, Niskayuna, NY (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/476,164

(22) PCT Filed: Jan. 5, 2018

(86) PCT No.: PCT/US2018/012471
§ 371 (c)(1),
(2) Date: Jul. 5, 2019

(87) PCT Pub. No.: WO2018/129241
PCT Pub. Date: Jul. 12, 2018

(65) Prior Publication Data

US 2019/0352969 A1 Nov. 21, 2019

(30) Foreign Application Priority Data

Jan. 5, 2017 (CN) ..... 201710007096.8

(51) Int. Cl.
*E21B 7/06* (2006.01)
*E21B 44/04* (2006.01)
(Continued)

(52) U.S. Cl.
CPC ..... *E21B 7/06* (2013.01); *E21B 17/10* (2013.01); *E21B 44/04* (2013.01); *E21B 47/022* (2013.01); *E21B 47/12* (2013.01)

(58) Field of Classification Search
CPC ..... E21B 7/06; E21B 44/04; E21B 47/022
See application file for complete search history.

(56) References Cited

U.S. PATENT DOCUMENTS 3,129,776 A * 4/1964 Mann ..... E21B 7/062 175/76
4,635,736 A 1/1987 Shirley
(Continued)

FOREIGN PATENT DOCUMENTS

EP 0841462 A2 5/1998

OTHER PUBLICATIONS

Notification of Transmittal of the International Search Report and the Written Opinion of the International Searching Authority; PCT/US2018/012471 filed Jan. 5, 2018; 16 pages.

*Primary Examiner* — Shane Bomar
(74) *Attorney, Agent, or Firm* — Cantor Colburn LLP

(57) ABSTRACT

A drilling system includes a rotatable string for connecting with a bit for drilling a borehole, and an active stabilizer which includes a body having an outer surface for contacting a wall of the borehole, and a plurality of actuators connecting the body and the string and capable of driving the string to deviate away from a center of the borehole with a displacement to change a drilling direction. The drilling system further includes a module for measuring direction parameters including at least one of a declination angle and an azimuth angle of the borehole, a module for measuring imbalance parameters including at least one of a lateral force, a bending moment and a torque near the drill bit, and a controller including a calculator for calculating an adjust-
(Continued)

ment needed for the displacement, based on the measured parameters and expected values of these parameters.

15 Claims, 16 Drawing Sheets

(51) Int. Cl.

| | |
|---|---|
| ***E21B 47/022*** | (2012.01) |
| ***E21B 17/10*** | (2006.01) |
| ***E21B 47/12*** | (2012.01) |

(56) References Cited

U.S. PATENT DOCUMENTS

| | | | | |
|---|---|---|---|---|
| 4,811,792 | A | 3/1989 | Lembcke et al. | |
| 5,752,572 | A * | 5/1998 | Baiden | E21B 44/005 175/26 |
| 6,470,974 | B1 * | 10/2002 | Moore | E21B 4/18 175/45 |
| 6,843,332 | B2 * | 1/2005 | Eppink | E21B 4/18 175/73 |
| 7,136,795 | B2 * | 11/2006 | Downton | E21B 7/04 703/10 |
| 8,210,283 | B1 | 7/2012 | Benson et al. | |
| 2004/0118612 | A1 * | 6/2004 | Haci | E21B 44/00 175/61 |
| 2004/0222023 | A1 * | 11/2004 | Haci | E21B 7/068 175/61 |
| 2015/0218934 | A1 | 8/2015 | Turner | |

* cited by examiner

ROTARY STEERABLE DRILLING SYSTEM AND METHOD WITH IMBALANCED FORCE CONTROL

CROSS REFERENCE TO RELATED APPLICATIONS

This is a U.S. National Stage of Application No. PCT/US2018/012471, filed on Jan. 5, 2018, which claims the benefit of Chinese Patent Application No. 201710007096.8, filed on Jan. 5, 2017, the disclosures of which are incorporated herein by reference.

FIELD OF THE INVENTION

The present invention generally relates to a directional drilling system and method, and in particular, to a rotary steerable drilling system and method with imbalanced force control.

BACKGROUND OF THE INVENTION

An oil or gas well often has a subsurface section that needs to be drilled directionally. Rotary steerable systems, also known as "RSS," are designed to drill directionally with continuous rotation from the surface, and can be used to drill a wellbore along an expected direction and trajectory by steering a drill string while it's being rotated. Thus rotary steerable systems are widely used in such as conventional directional wells, horizontal wells, branch wells, etc. During the drilling, the practice trajectory may deviate the designed trajectory due to various reasons, and thus it may be needed to repeatedly adjust the practice trajectory to follow the designed trajectory, which may slow down the drilling process and reduce the drilling efficiency.

Typically, there are two types of rotary steerable systems: "push-the-bit" systems and "point-the-bit" systems, wherein the push-the-bit system has a high build-up rate but forms an unsmooth drilling trajectory and rough well walls, whereas the point-the-bit system forms relatively smoother drilling trajectory and well walls, but has a relatively lower build-up rate. The push-the-bit systems use the principle of applying a lateral force to the drill string to push the bit to deviate from the well center in order to change the drilling direction. The drilling qualities of the existing push-the-bit systems are much subjected to the conditions of well walls. Uneven formation and vibrations of the drill bit during the drilling may cause a rough well wall and an unsmooth drilling trajectory. Thus it is hard to achieve high steering precision. A rough well wall may lead difficulties in casing (well cementing), trip-in and trip-out operations.

How to exactly drill a downhole along a desired trajectory with high quality and high efficiency while fully rotating the drill tool is always a big challenge.

Accordingly, there is a need to provide a new rotary steerable system and method to solve at least one of the above-mentioned technical problems.

SUMMARY OF THE INVENTION

A steerable drilling system includes a rotatable drill string for connecting with a drill bit for drilling a borehole along a drilling trajectory, and an active stabilizer which includes a body having an outer surface for contacting a wall of the borehole, and a plurality of actuators connecting the body and the drill string and capable of driving the drill string to deviate away from a center of the borehole with a displacement to change a drilling direction. The drilling system further includes a direction parameter measurement module for measuring direction parameters including at least one of an inclination angle and an azimuth angle of the borehole, an imbalance parameter measurement module for measuring imbalance parameters including at least one of a lateral force, a bending moment and a torque at a measuring position near the drill bit, and a controller for controlling the drilling trajectory based on the measured direction and imbalance parameters. The controller includes a calculator for calculating an adjustment needed for the displacement, based on the measured direction and imbalance parameters and expected values of these parameters.

A steerable drilling method includes drilling a borehole along a drilling trajectory with a drill bit connected a rotatable drill string, wherein the rotatable drill string is coupled with an active stabilizer for driving the drill string to deviate away from a center of the borehole with a displacement to changing a drilling direction. The method further includes measuring direction parameters and imbalance parameters during the drilling, and controlling the drilling trajectory based on the measured direction and imbalance parameters. The direction parameters includes at least one of an inclination angle and an azimuth angle of the borehole, and the imbalance parameters includes at least one of a lateral force, a bending moment and a torque at a measuring position near the drill bit. The controlling includes calculating an adjustment needed for the displacement based on the measured direction and imbalance parameters and expected values of these parameters, and driving the plurality of actuators to move to achieve the adjustment.

BRIEF DESCRIPTION OF THE DRAWINGS

The above and other aspects, features, and advantages of the present disclosure will become more apparent in light of the subsequent detailed description when taken in conjunction with the accompanying drawings in which:

FIGS. 15A and 15B illustrate a deviation between an actual drilling trajectory and a desired drilling trajectory, wherein FIG. 15A is a schematic view showing the desired drilling trajectory and the actual drilling trajectory determined by an active stabilizer and a drill bit of a drilling system, and FIG. 15B is a schematic view showing a position of the drill bit.

DETAILED DESCRIPTION OF THE INVENTION

One or more embodiments of the present disclosure will be described below. Unless defined otherwise, technical and scientific terms used herein have the same meaning as is commonly understood by one of skill in the art to which this invention belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and mean any, some, or all of the listed items. The use of "including," "comprising" or "having" and variations thereof herein are meant to encompass the items listed thereafter and equivalents thereof as well as additional items. The term "coupled" or "connected" or the like is not limited to being connected physically or mechanically, but may be connected electrically, directly or indirectly.

Embodiments of the present disclosure relate to a rotary steerable drilling system and method for directional drilling a borehole or wellbore. The rotary steerable drilling system and method involve measuring both direction parameters and imbalance parameters and controlling the drilling trajectory based on the measured direction and imbalance parameters. The system and method can optimize the drilling process, and improve the accuracy and smoothness of the drilling trajectory.

Figure 1:
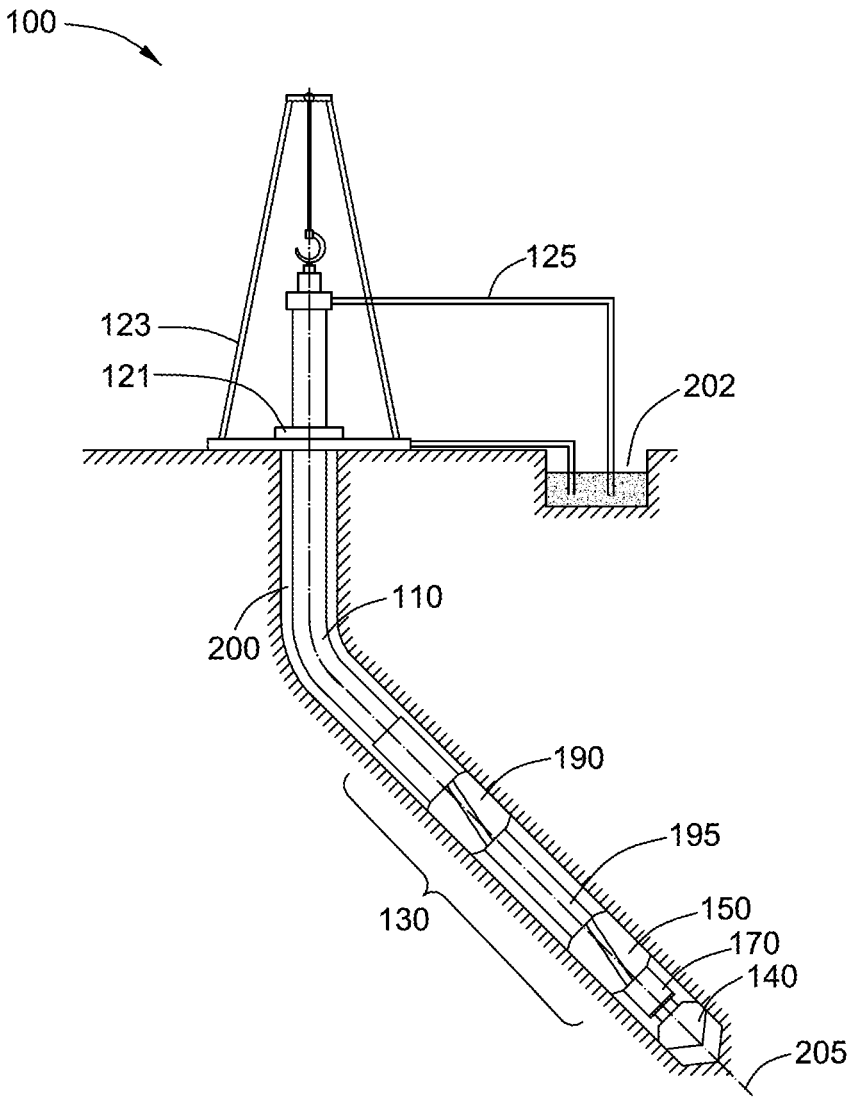
FIG. 1 is a side view of a rotary steerable system including a drill string, a fixed stabilizer and an active stabilizer.

FIG. 1 illustrates an exemplary rotary steerable drilling system 100 used for directionally drilling a borehole 200 in the earth. The rotary steerable drilling system 100 includes a drill string 110 rotatably driven by a rotary table 121 (or by top drive instead) from the surface and is coupled with a drill bit 140 at a distal end thereof. The drill bit 140 has cutting ability, and once is rotated, is able to cut and advance into the earth formation. The drill string 110 typically is tubular. A bottom hole assembly (BHA) 130 forms a downhole section of the drill string 110, which typically houses measurement control modules and/or other devices necessary for control of the rotary steerable drilling system. The length of the drill string 110 can be increased as it progresses deeper into the earth formation, by connecting additional sections of drill string thereto.

In addition to the rotary table 121 for providing a motive force to rotate the drill string 110, the rotary steerable drilling system 100 may further include a drilling rig 123 for supporting the drill string 110, a mud tube 125 for transferring mud from a mud pool 202 to the drill string 110 by a mud pump (not shown). The mud may serve as a lubricating fluid and be repeatedly re-circulated from the mud pool 202, through the mud tube 125, the drill string 110 and the drill bit 140, under pressure, to the borehole 200, to take away cuttings (rock pieces) that are generated during the drilling to the mud pool 202 for reuse after the cuttings are separated from the mud by, such as filtration.

Figure 2:
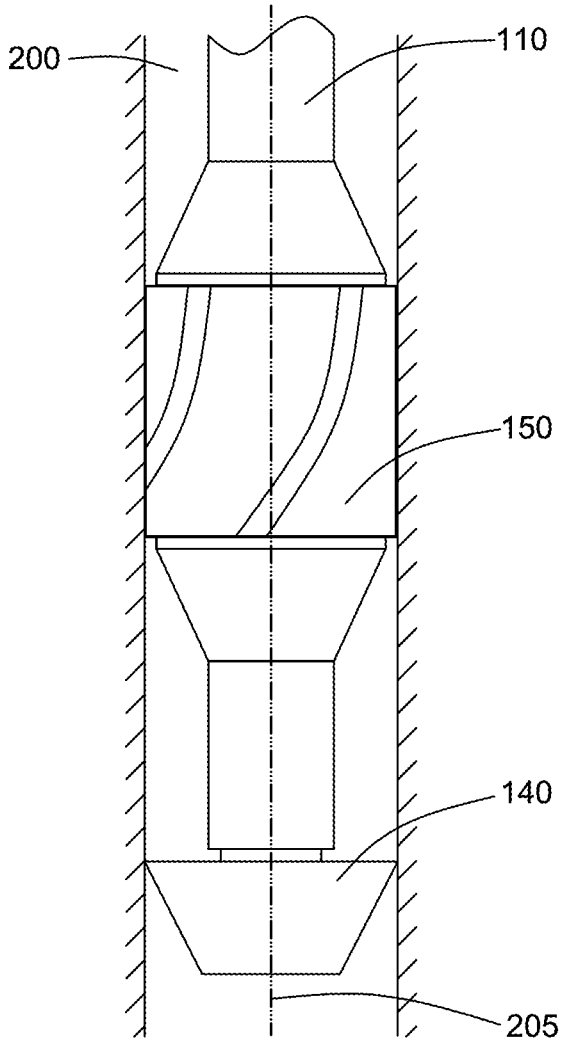
FIG. 2 illustrates a first position state of the active stabilizer and the drill string of FIG. 1.
Figure 3:
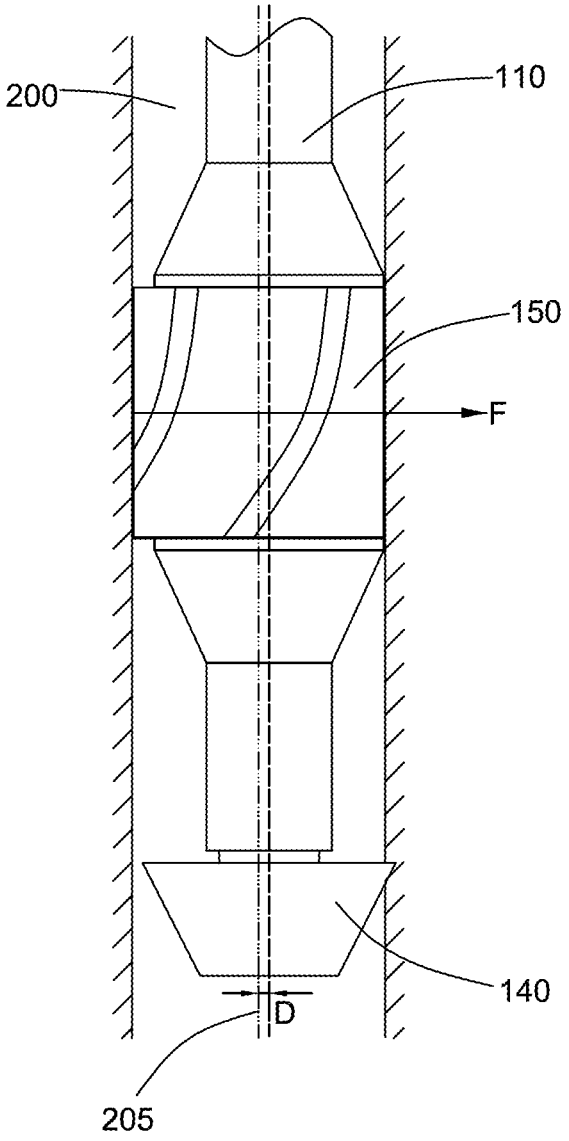
FIG. 3 illustrates a second position state of the active stabilizer and the drill string of FIG. 1.

In order to achieve directional control while drilling, the rotary steerable drilling system 100 may include an active stabilizer 150, which is capable of stabilizing the drill string 110 against undesired radial shaking to keep the drill string 110 at the center of the borehole 200 when the drilling is along a straight direction, as well as driving the drill string 110 to deviate away from a center the borehole 200 being drilled in order to change the drilling direction when it is needed to change the drilling direction during the drilling. As shown in FIG. 2, when the rotary steerable system is drilling along a straight direction, a center axis of the drill string 110 substantially coincides with a center axis 205 of the borehole 200 around the position of the active stabilizer 150, the drill bit is located in the borehole center, and an outer surface of the active stabilizer 150 contacts the inner surface of the borehole 200 to reduce or prevent undesired radial shaking. When it is needed to change the drilling direction while drilling, the active stabilizer 150 may push the drill string 110 to make the center axis of the drill string 110 deviate away from the borehole center with a desired displacement, and keep the displacement while the drill string 110 is rotating. As shown in FIG. 3, against the inner surface of the borehole 200, the active stabilizer 150 pushes the drill string 110 with a lateral force, to make the center axis of the drill string 110 around the position of the active stabilizer 150 deviate away from the borehole center 205 with a desired displacement D along a desired direction.

During the drilling, there may be a continuous contact between the active stabilizer 150 and the inner surface of the borehole 200, and therefore the drill string 110 may be continuously pushed by the active stabilizer to deviate so as to change the drilling direction when it is needed. Moreover, there is less impact from borehole rugosity, and the active stabilizer 150 can also function as a general stabilizer for stabilizing the drill string 310 against undesired radial shaking during the drilling.

Returning to FIG. 1, the rotary steerable drilling system 100 may further include one or more fixed stabilizers 190 fixed on the drill string 110. In some embodiments, the one or more fixed stabilizers 190 are above the active stabilizer 150, i.e., farther away from the drill bit 140 at the distal end of the drill string 110, compared with the active stabilizer 150. The fixed stabilizer 190 has an outer surface for contacting a wall of the borehole 200, and can stabilize the drill string 110 against radial shaking during the drilling to keep the drill string 110 at the center of the borehole 200. In some embodiments, the fixed stabilizer 190 includes an annular structure having an outer diameter slightly smaller than the diameter of the borehole. The active stabilizer 150 and the nearest fixed stabilizer 190 may be connected through a slightly flexible structure 195, for example, a string section with a thinner wall comparing with other sections of the drill string 110. The string section between the two stabilizers may bend a little while changing the drilling direction, which may improve the built-up rate and smoothness of the drilling trajectory.

Figure 4:
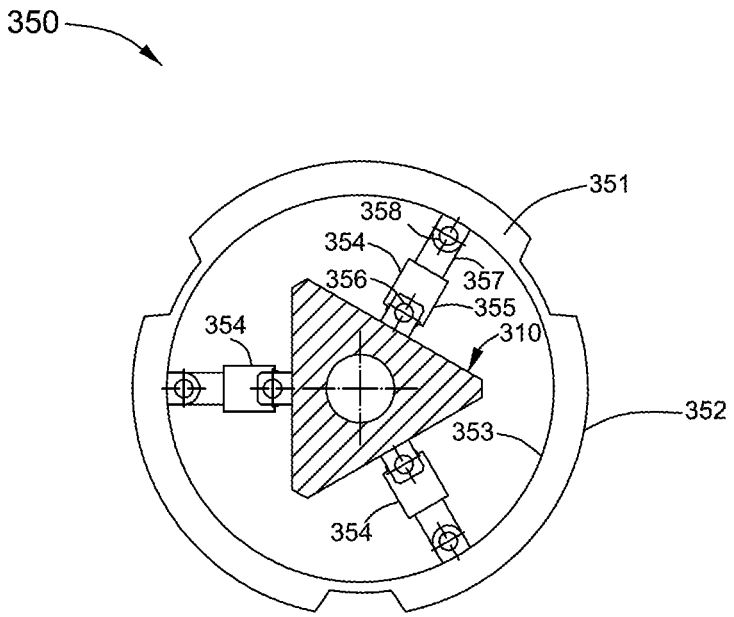
FIG. 4 is a schematic cross sectional view of an active stabilizer that can be used in a rotary steerable system like that of FIG. 1, in accordance with one embodiment of the present disclosure.
Figure 5:
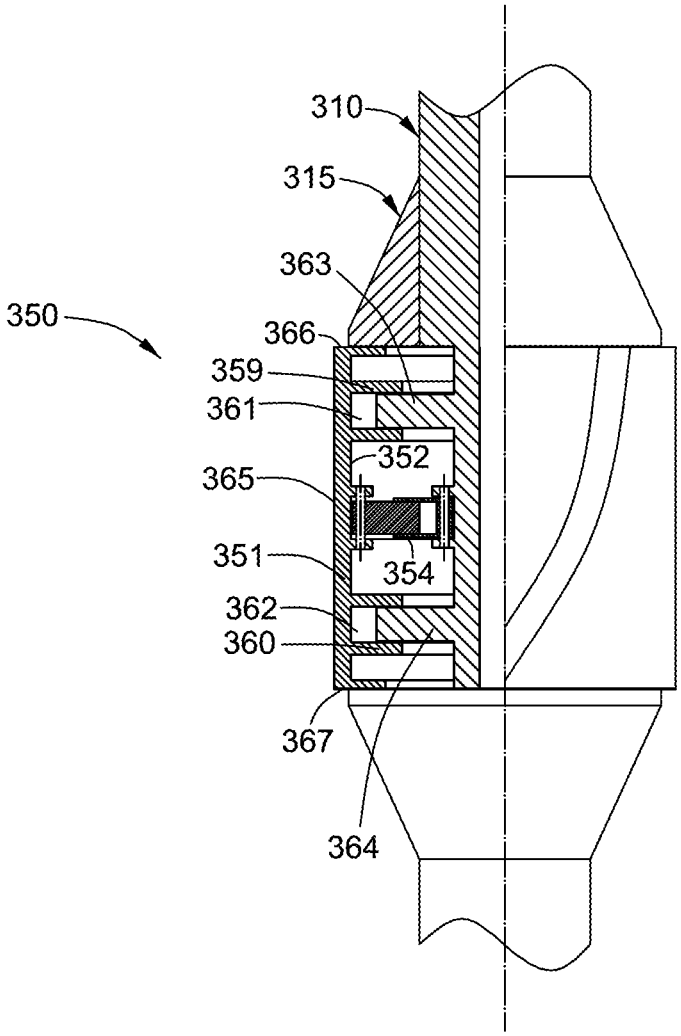
FIG. 5 is a partial longitudinal section view illustrating how the active stabilizer of FIG. 4 is coupled to a drill string.

FIGS. 4 and 5 illustrate an active stabilizer 350 that can be used in a rotary steerable system like the system 100 of FIG. 1. The active stabilizer 350 includes a body 351 having an outer surface 352 for contacting a wall of a borehole being drilled, an inner surface 353 facing a drill string 310, and a plurality of actuators 354 connecting the body 351 and the drill string 310. In the specific embodiment as illustrated in FIG. 4, there are three such actuators 354. Each of the actuators 354 includes a cylinder 355 rotatably coupled to one of the drill string 310 and the body 351 through a first pivot joint 356, and a piston 357 rotatably coupled to the other of the drill string 310 and the body 351 through a second pivot joint 358. The piston 357 is driven by a hydraulic system and is movable within the cylinder 355. Therefore, as for each actuator 354, the cylinder 355 is rotatable around the first pivot joint 356, the piston 357 is rotatable around the second pivot joint 358, and the piston 357 is movable within the cylinder 355. The plurality of actuators 354 are capable of driving the drill string 310 to deviate away from the borehole center with a displacement and stabilizing the drill string 310 against radial shaking during the drilling.

The body 351 of the active stabilizer 350 further includes at least one guiding portion 359/360 projecting from the inner surface 353 towards the drill string 310, wherein each guiding portion 359/360 defines at least one groove 361/362. The drill string 310 includes at least one sliding portion 363/364, each capable of sliding within one of the at least one groove 361/362 defined in the body 351 of the active stabilizer 350, to constrain relative movement between the drill string 310 and the active stabilizer 350 along an axial direction of the drill string 310 and guide relative movement between the drill string 310 and the active stabilizer 350 along a radial direction substantially perpendicular to the axial direction of the drill string 310. In some embodiments, the at least one sliding portion 363/364 projects outward from an outer surface of the drill string 310. In some embodiments, the sliding portion 363/364 is a sliding disk. In some embodiments, the groove 361/362 is an annular groove.

In some embodiments, the body 351 of the active stabilizer 350 includes an annular structure 365 having an outer diameter slightly smaller than the diameter of the borehole being drilled. An outer peripheral surface of the annular structure 365 contacts the borehole wall to help the actuators to push the drill bit away from the borehole center. In some embodiments, the annular structure 365 has opposite first and second axial ends 366 and 367, and the at least one guiding portion includes a first guiding portion 359 between the first axial end 366 of the annular structure 365 and the plurality of actuators 354 and a second guiding portion 360 between the second axial end 367 of the annular structure 365 and the plurality of actuators 354, along an axial direction of the annular structure.

The at least one guiding portion at the body 351 of the active stabilizer 350 and the at least one sliding portion at the drill string 310 coordinate with each other to guide the movement between the active stabilizer 350 and the drill string 310. By such a sliding mechanism, the motion and displacement of the active stabilizer can be accurately controlled, and undesired shaking and vibrations can be reduced.

Figure 6:
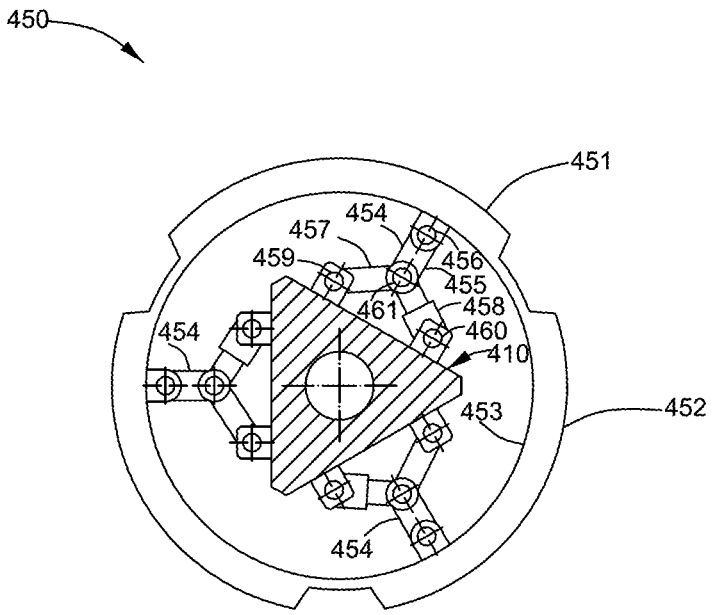
FIG. 6 is a schematic cross sectional view of an active stabilizer that can be used in a rotary steerable system like that of FIG. 1, in accordance with another embodiment of the present disclosure.

FIG. 6 illustrates another active stabilizer 450 that can be used in a rotary steerable system like the system 100 of FIG. 1. Similar to the active stabilizer 350, the active stabilizer 450 includes a body 451 having an outer surface 452 for contacting a wall of a borehole being drilled, an inner surface 453 facing a drill string 410, and a plurality of actuators 454 connecting the body 451 and the drill string 410.

Each of the actuators 454 includes a first link element 455 rotatably coupled to the body 451 via a first pivot joint 456, a second link element 457 and a third link element 458 rotatably coupled to the drill string 410 via a second pivot joint 459 and a third pivot joint 460, respectively. The first, second and third link elements 455, 457, 458 are connected via a fourth pivot joint 461. The third and fourth pivot joints 460, 461 are movable towards each other or away from each other. In some embodiments, the third link element 458 includes a cylinder and a piston movable within the cylinder. The plurality of actuators 454 are capable of driving the drill string 410 to deviate away from the borehole center with a displacement and stabilizing the drill string 410 against radial shaking during the drilling. By continuously and harmoniously controlling the plurality of actuators 454 to drive the drill string 310 to deviate away, the drilling direction can be changed according to a predetermined trajectory.

Similar to the active stabilizer 350, the active stabilizer 450 also has a sliding mechanism including at least one guiding portion at the body 451 of the active stabilizer 450 and at least one sliding portion at the drill string 410, which coordinate with each other to guide the movement between the active stabilizer 450 and the drill string 410. The specific implementation way of the sliding mechanism may be the same as that in the active stabilizer 350, and therefore will not be repeated.

There may be one or more measurement or control modules and/or other devices, included in the rotary steerable system, for example, installed in a section 170 between the drill bit 140 and the active stabilizer 150 of the rotary steerable system 100 as shown in FIG. 1, for driving and controlling the plurality of actuators. For example, there may be a hydraulic system for driving the plurality of actuators, one or more measurement modules for continuously measuring or estimating displacements of the plurality of actuators, a drilling direction of the drill bit, and other parameters of the drilling, and/or a controller for harmoniously controlling the plurality of actuators based on measurement or estimation results.

In some embodiments, a direction parameter measurement module is used for measuring direction parameters, including at least one of an inclination angle and an azimuth angle of the borehole, and an imbalance parameter measurement module is used for measuring imbalance parameters, including at least one of a lateral force, a bending moment and a torque at a measuring position near the drill bit. The measurement results can be used to harmoniously control the hydraulic pistons to achieve precise trajectory control, in order to reach high drilling quality. The direction parameter measurement module may be a measurement while drilling (MWD) module used for continuously measuring the bit position and direction (gasture). The imbalance parameter measurement module may be a MWD module used for continuously measuring a three dimensional force, a three dimensional bending moment and a torque near the bit. The direction parameter measurement module and the imbalance parameter measurement module may be integrated in a single unit or may be dividually set. In some embodiments, the imbalance parameters may further include vibration parameters, such as vibration amplitudes, vibration frequencies and vibration directions of the drill bit. The vibration parameters may be measured by a three dimensional accelerometer.

Figure 7:
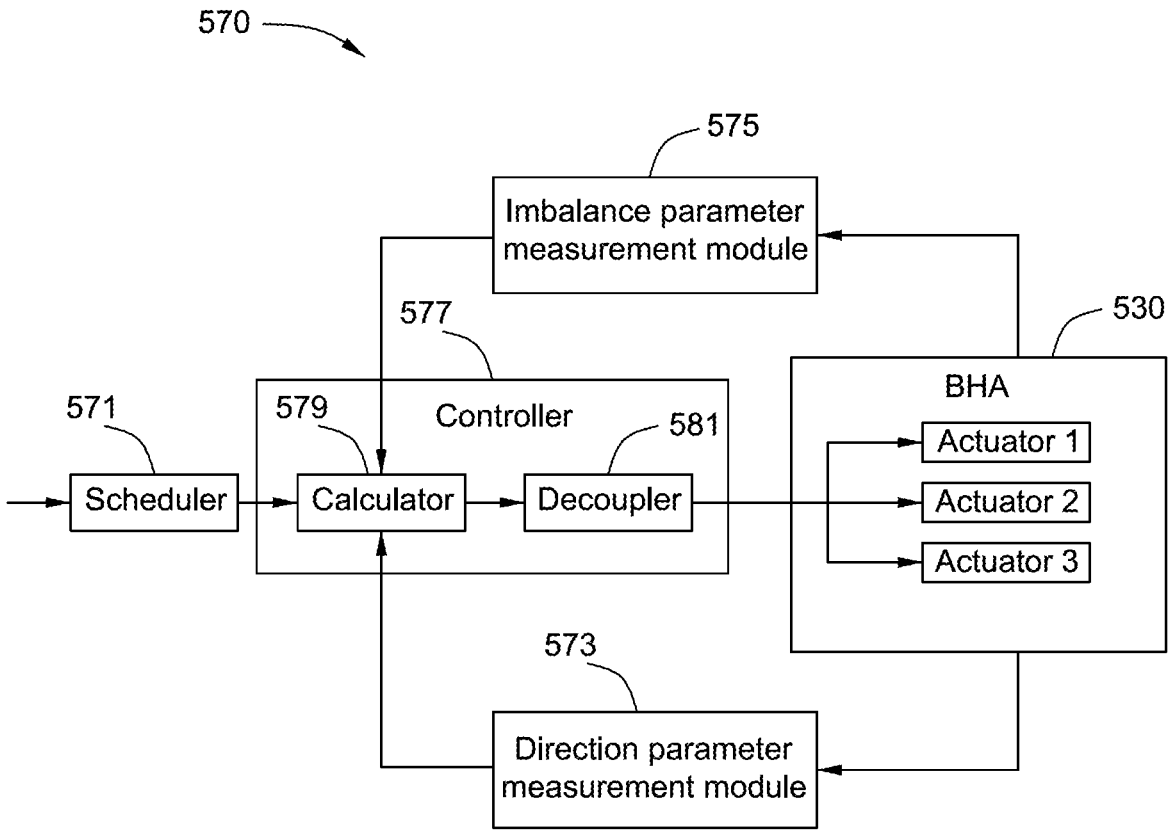
FIG. 7 is a schematic block diagram of a control system capable of achieving trajectory control for a rotary steerable system including an active stabilizer, in accordance with one embodiment of the present disclosure.

FIG. 7 illustrates a schematic block diagram of a control system 570 capable of achieving trajectory control for a rotary steerable drilling system, a BHA 530 of which includes an active stabilizer with three actuators, like the rotary steerable drilling systems as described herein above. The control system 570 includes a scheduler 571 for receiving trajectory input (for example, input commands or parameters) and planning control parameters used for the trajectory control based on the received trajectory input, a direction parameter measurement module 573 for measuring the direction parameters, an imbalance parameter measurement module 575 for measuring the imbalance parameters, and a controller 577 for controlling the drilling trajectory and improving smoothness of the drilling trajectory based on the measured direction and imbalance parameters. Different modules of the control system 570 may be installed in different sections or in a same section, depending on specific conditions and/or needs.

The control parameters planned by the scheduler 571 may include expected values of the direction and imbalance parameters. The direction parameter measurement module 573 can accurately and real-time measure the direction parameters, including but not limited to an azimuth angle and an inclination angle of the borehole being drilled. The imbalance parameter measurement module 575 can accurately and real-time measure the imbalance parameters, including but not limited to a three dimensional (3D) force, a 3D bending moment and a torque near the drill bit of the rotary steerable system, as well as a vibration amplitude, a vibration frequency and a vibration direction of the drill bit. The controller 577 can estimate the needed adjustments for actuation mechanism based on a comparison between the measured parameters and the expected values of these parameters. Then the adjustments are decoupled for the expected motion of each actuator. The controller 577 includes a calculator 579 for calculating an adjustment (change) needed for the displacement of the drill string away from the borehole center, based on the measured direction and imbalance parameters and expected values of these parameters, and a decoupler 581 for decoupling the adjustment into expected motions of the plurality of actuators. Via such a decoupler, the desired adjustment for the displacement of the drill string, which displacement is driven by the active stabilizer, is converted into expected motions of the three actuators.

As the adjustment fuses the direction control and imbalanced force control, the control system 570 can accurately control the drilling direction with high borehole quality by compensating the deviation of force, bending moment, torque and trajectory in advance. By such a control method, the drilling system can significantly improve the accuracy and smoothness of drilling trajectory.

Figure 8:
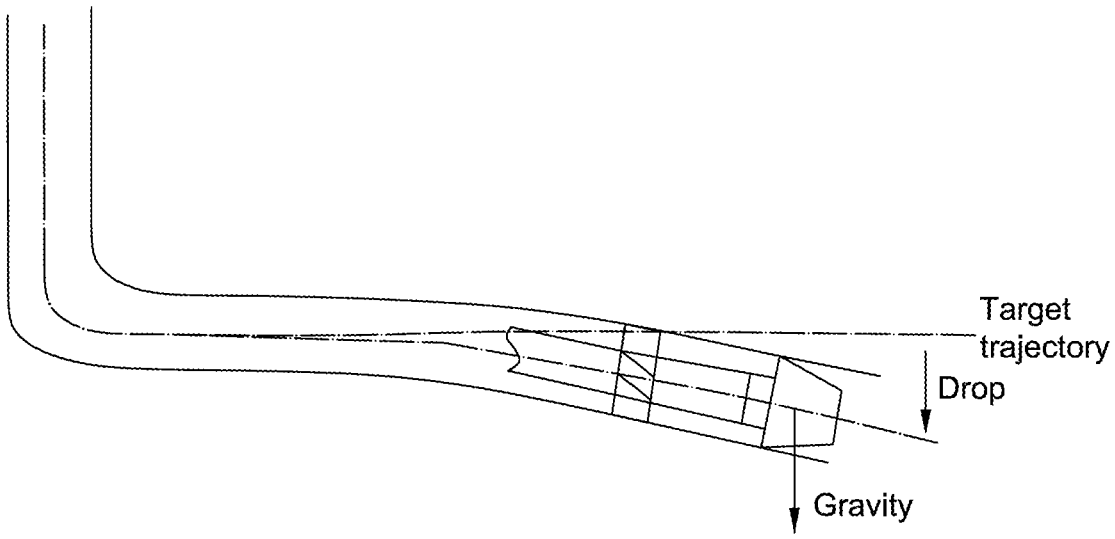
FIG. 8 illustrates a possible drilling trajectory drop due to gravity while drilling along a horizontal or sloping trajectory.
Figure 9:
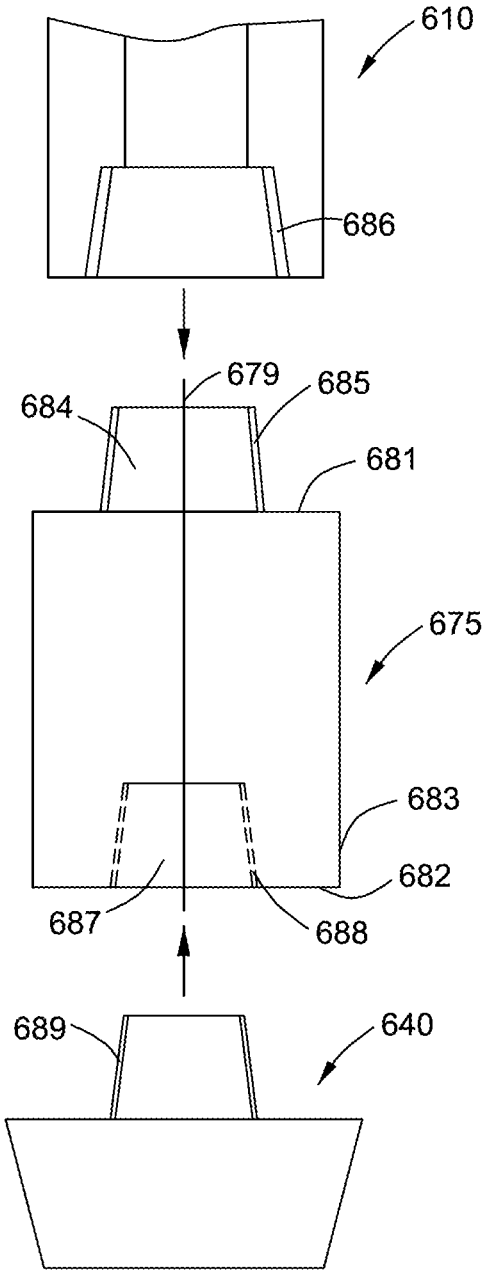
FIG. 9 is a schematic erection view of an imbalance parameter measurement module for use in the rotary steerable system, according to one embodiment of the present invention.
Figure 10:
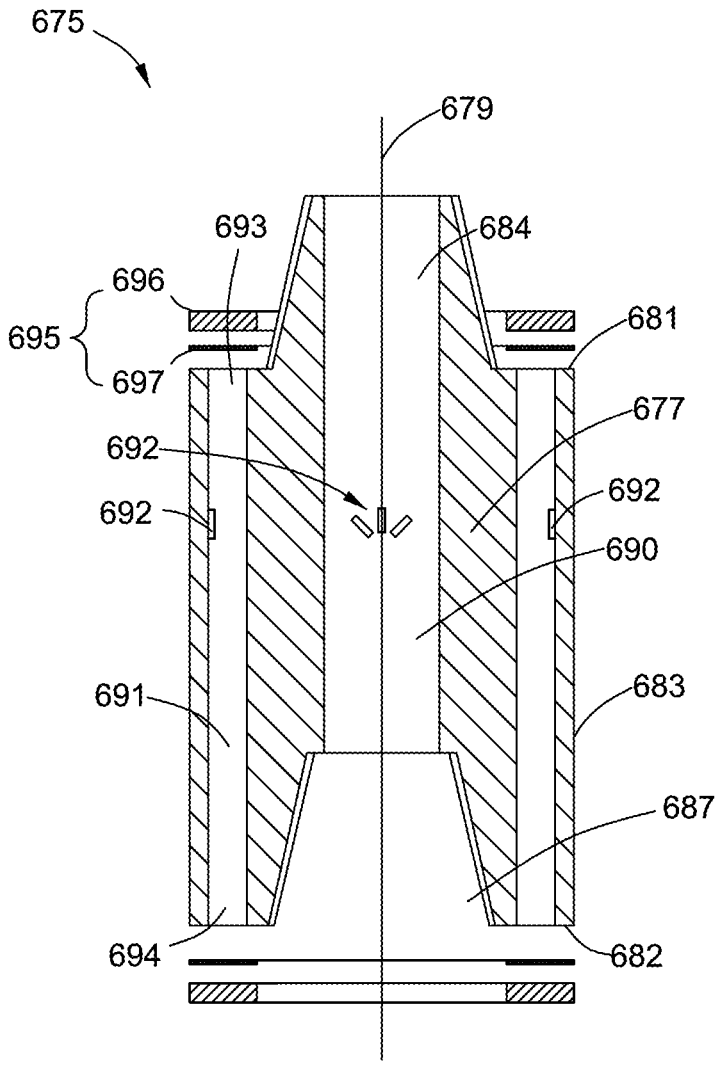
FIG. 10 is a schematic structural view of the imbalance parameter measurement module of FIG. 9.

As illustrated in FIG. 8, while drilling along a horizontal or sloping trajectory, the gravity impact of the drill bit and BHA may lead a drilling trajectory drop, caused by a deviation of the drill bit and BHA along the direction of gravity. The gravity impact can be estimated per a sophisticated drilling system model. To compensate the gravity impact and avoid trajectory drop, the expected bending moment and lateral force at the position of the imbalance parameter measurement module can be estimated and considered in the calculation of the adjustment in the displacement of the drill string at the position of the active stabilizer.

FIGS. 9-13 illustrate an imbalance parameter measurement module 675 that can be used in a rotary steerable drilling system including a drill string 610 and a drill bit 640, like the rotary steerable drilling systems described herein above. The imbalance parameter measurement module 675 may form a near-end section of the drill string 610, between the drill bit 640 and an upper section of the drill string 610. In some embodiments, the imbalance parameter measurement module 675 is substantially cylindrical and coaxial with the drill string 610 and drill bit 640, and it can rotate with the drill string 610 and drill bit 640. The imbalance parameter measurement module 675 is configured to obtain various imbalance information in real time, unify the information to calculate desired results (for example, parameters), and transmit the results to a drilling control unit for control.

The imbalance parameter measurement module 675 includes a substantially cylindrical body 677 rotatable around a rotation axis 679 thereof. The body 677 has a first end surface 681 and a second end surface 682 at two axial ends thereof, respectively, and an outer circumferential surface 683 extending between the first and second end surfaces 681, 682.

There may be two connecting parts at the two axial ends of the body 677, for coupling with the drill string 610 and the drill bit 640, respectively. For example, there is a protrusion part 684 protruding form the first end surface 681. Threads 685 and 686 respectively on an outer surface of the protrusion part 684 and on an inner surface of the drill string 610 match with each other to connect the body 677 and the drill string 610. There is a recessed part 687 recessing inwards from the second end surface 682. Threads 688 and 689 respectively on an inner surface of the recessed part 687 and on an outer surface of the drill bit 640 match with each other to connect the body 677 and the drill bit 640. There is no limit to the way for connecting the body 677 with the drill string 610 or the drill bit 640. The body 677 may also be connected with the drill string 610 or the drill bit 640 in other ways, such as by flanges, bolts or the like.

Figure 11:
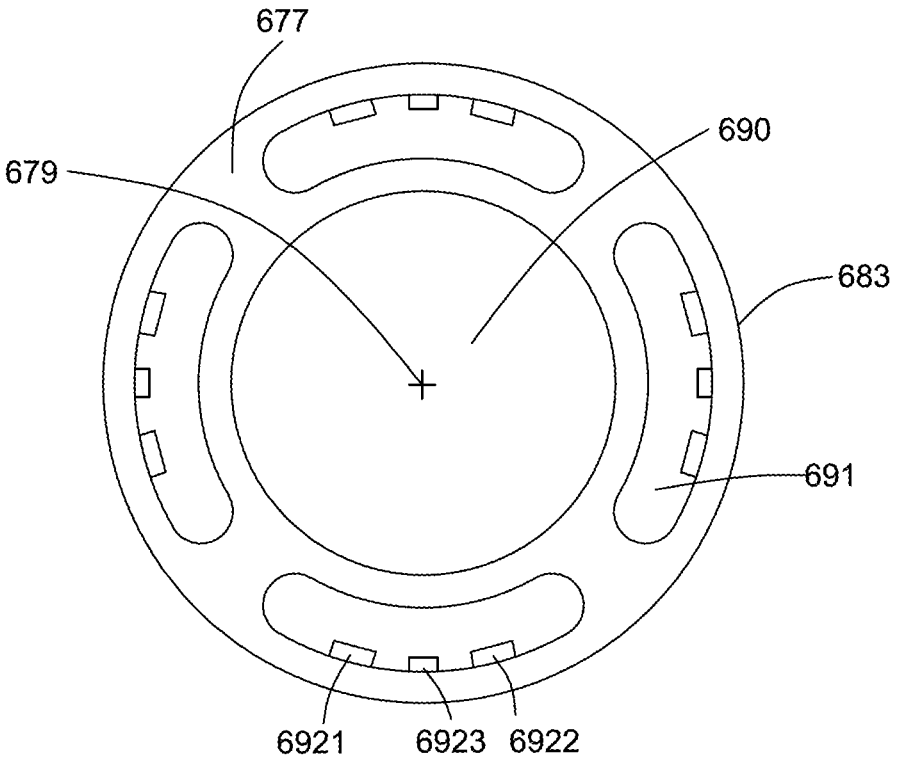
FIG. 11 is a schematic sectional view of the imbalance parameter measurement module of FIG. 10.

The body 677 defines a passage 690 therein for the liquid communication with passages in the drill string 610 and the drill bit 640. The body 677 further defines therein at least one sensing chamber 691, each for accommodating at least one sensor 692 for measuring the imbalance parameters. The sensor 692 may include one or more measuring units that can be used to measure at least one of the imbalance parameters such as a lateral force, a bending moment, a torque, a vibration amplitude, a vibration frequency and a vibration direction. For example, the sensor 692 may include a strain component, a 3D accelerometer, or a combination thereof. The sensing chamber 691 has at least one opening 693 on the first end surface 681. In some embodiments, as illustrated in FIG. 11, there are four sensing chambers 691 extending parallel to the rotation axis 679. Each of the sensing chambers 691 has a cross section of a long ellipse curved in conformity with the outer circumferential surface 683. The four sensing chambers 691 are distributed evenly along a circumferential direction of the body 677. Each of the sensing chambers 691 has two openings 693, 694 on the first and second end surfaces 681, 682, respectively.

The imbalance parameter measurement module 675 further includes a sealing member 695 disposed on the at least one end surface for sealing the sensing chambers 691. In some embodiments, the seal 695 includes a cover 696 for covering the opening 693 on the end surface 681 or the opening 694 on the end surface 682, and a sealing pad 697 disposed between the cover 696 and the end surface 681 or 682 for improving the sealing effect of the cover 696.

Figure 12:
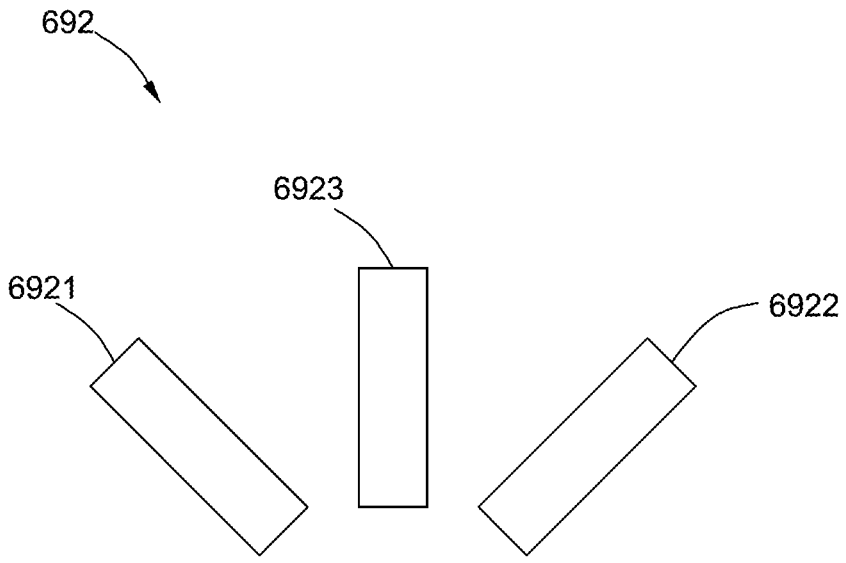
FIG. 12 is a schematic view illustrating an arrangement of a group of strain gauges of the imbalance parameter measurement module of FIG. 10.

The sensor 692 may include strain gauges. For example, the sensor 692 may include a group of a first, second and third strain gauge 6921, 6922, 6923, as illustrated in FIGS. 11 and 12. The first, second and third strain gauges 6921, 6922, 6923 are disposed on the inner wall of the sensing chamber 691 along three different directions, and are used for measuring the pressure, lateral force, bending moment, torque or the like. Therefore, there are totally four sensors 692 in the imbalance parameter measurement module 675 and each of the sensors 692 includes a group of three strain gauges 6921, 6922, 6923. By using such a combination of the strain gauges, various 3D forces, moments and torques near the drill bit may be measured and separated to desired parameters, which further improves the measurement accuracy.

In some embodiments, the first, second and third strain gauges 6921, 6922, 6923 are mounted on the side of the inner wall of the sensing chamber 691 near the outer circumferential surface 683. Each of the strain gauges has a larger deformation amount on the side near the outer circumferential surface 683 than on the other side, such that the signal to noise ratio of the sensor 692 can be increased, and the measurement accuracy can be improved.

In some embodiments, as illustrated in FIG. 12, the first strain gauge 6921 is inclined at a first angle to the third strain gauge 6923, and the second strain gauge 6922 is inclined at a second angle to the third strain gauge 6923, wherein the first angle substantially equals to the second angle. The first and second strain gauges 6921, 6922 are symmetric to each other with respect to the third strain gauge 6923. In some embodiments, the first and second angles are about 45 degree, such that an angle between the first strain gauge 6921 and the second strain gauge 6922 is about 90 degree, which makes the calculation simple, and improves the precision of the measured results.

Figure 13:
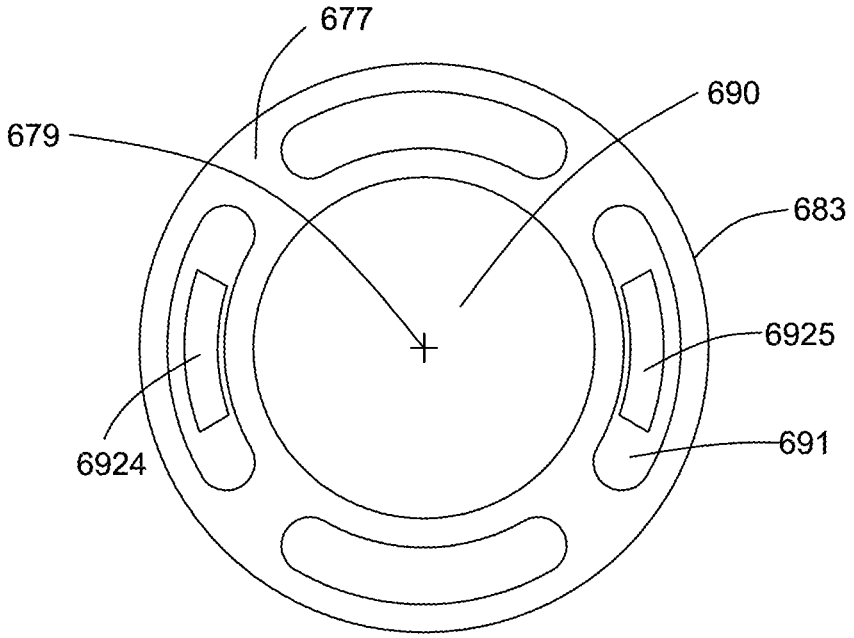
FIG. 13 is a schematic sectional view of an imbalance parameter measurement module for use in the rotary steerable system, according to another embodiment of the present invention.

In some embodiments, the sensor 692 may further include one or more pairs of 3D accelerometers, wherein each pair of 3D accelerometers are symmetrically arranged with respect to the rotation axis 679 of the body 677. For example, as illustrated in FIG. 13, the sensor 692 includes a pair of 3D accelerometers 6924, 6925 symmetric to each other with respect to the rotation axis 679 of the body 677, and each of accelerometers 6924, 6925 is located in one of the sensing chambers 691. By use of the one or more pairs of 3D accelerometers, motion parameters and vibration parameters of the rotation of the drill bit can be obtained separately.

In some embodiments, the 3D accelerometers may be integral or replaced with one-dimension accelerometers or two-dimension accelerometers to simplify the design by sacrificing a bit of accuracy.

The drilling data obtained from the one or more sensors 692 may be transmitted to a drilling control unit via cables, ultrasonic wave, acoustic signals, or radio-frequency signals. In some embodiments, the sensor 692 may be supplied with power via cables or batteries in the sensing chamber 691.

The control of the drilling trajectory based on the measured direction and imbalance parameters are demonstrated with reference to some non-limiting examples of mathematic models hereinafter. The following examples of mathematic models are set forth to provide those of ordinary skill in the art with a detailed description of how the calculation and control herein are implemented, and are not intended to limit the scope of what the inventors regard as their invention.

Figure 14A:
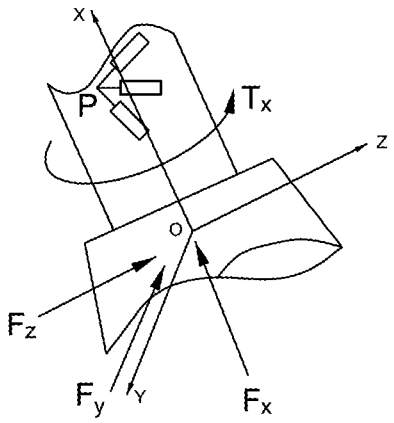
FIGS. 14A-14C illustrate a plurality of strain gauges which are installed near a position P on a drill string section adjacent to the drill bit, and used to measure imbalance parameters at a position O on the drill bit.
Figure 14B:
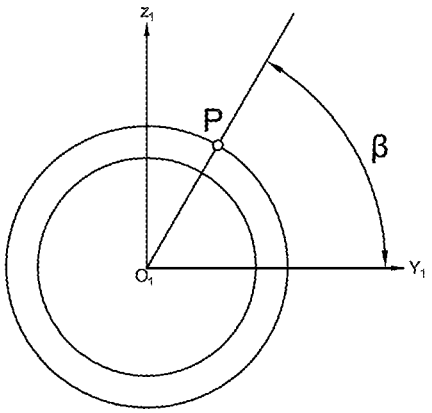
Figure 14C:
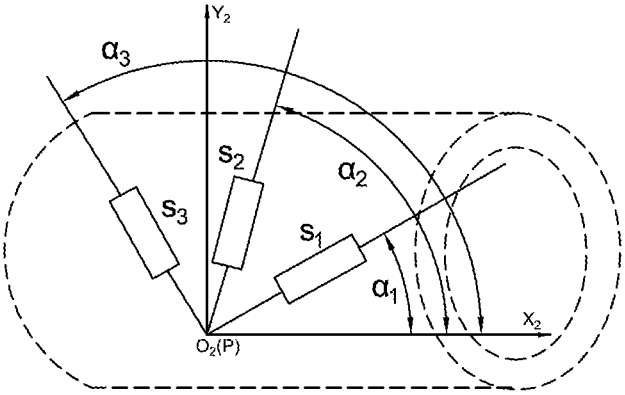

The strain of the strain gauge is proportional to its resistance that can be easily measured by electronic device. The imbalance parameters such as the lateral force and bending moment can be calculated based on the strains of the gauges through a mathematic model. An exemplary mathematic model between the strains and the imbalance parameters will be illustrated in conjunction with FIGS. 14A-14C. As shown in FIGS. 14A-14C, a plurality of sensors are used to measure imbalance parameters at a position O on the drill bit, including axis pressure $F_x$, lateral pressure $F_y$, lateral pressure $F_z$, and torque $T_x$. Each of the sensors includes three strain gauges S1, S2, S3 installed at a position P (where axes of the three strain gauges meet) on the drill string. The mathematic model between the strains and the imbalance parameters is as follow:

$$\begin{cases} \varepsilon_{a1} = f(L, {}^{\circ}R, {}^{\circ}r, {}^{\circ}\alpha_1, {}^{\circ}\beta_1, {}^{\circ}E, {}^{\circ}F_x, {}^{\circ}F_y, {}^{\circ}F_z, {}^{\circ}T_x) \\ \varepsilon_{a2} = f(L, {}^{\circ}R, {}^{\circ}r, {}^{\circ}\alpha_2, {}^{\circ}\beta_1, {}^{\circ}E, {}^{\circ}F_x, {}^{\circ}F_y, {}^{\circ}F_z, {}^{\circ}T_x) \\ \varepsilon_{a3} = f(L, {}^{\circ}R, {}^{\circ}r, {}^{\circ}\alpha_3, {}^{\circ}\beta_1, {}^{\circ}E, {}^{\circ}F_x, {}^{\circ}F_y, {}^{\circ}F_z, {}^{\circ}T_x) \\ \quad \ldots \\ \varepsilon_{an} = f(L, {}^{\circ}R, {}^{\circ}r, {}^{\circ}\alpha_n, {}^{\circ}\beta_m, {}^{\circ}E, {}^{\circ}F_x, {}^{\circ}F_y, {}^{\circ}F_z, {}^{\circ}T_x) \end{cases}$$

where $\varepsilon_{ai}$ is the strain of the $i^{th}$ strain gauge, L is the distance from P to O, R and r are the outer diameter and inner diameter of the drill string, respectively; $\alpha_i$ is an azimuth angle of the $i^{th}$ strain gauge, $\beta_j$ is an azimuth angle of the $j^{th}$ sensor in a circular surface, and E is the elastic modulus of the drill string material.

Figure 15A:
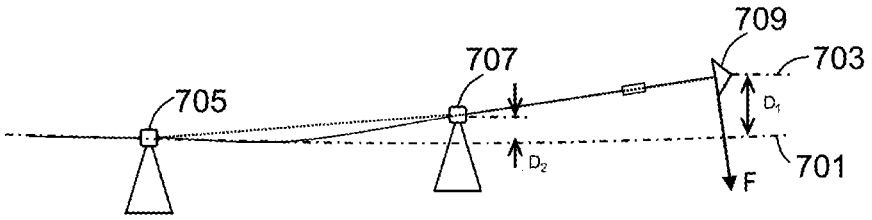
Figure 15B:
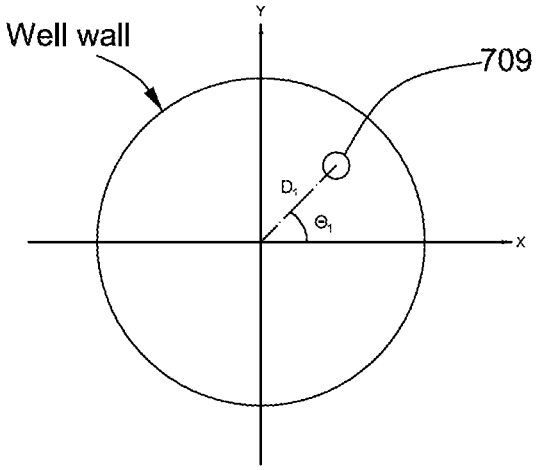

In a real application, the actual trajectory may deviate from the desired trajectory (target trajectory). For example, as illustrated in FIG. 15A, there is a target trajectory 701, but an actual trajectory 703 defined by an arc line connecting a center position of the drill string at a position of a fixed stabilizer 705, a center position of an active stabilizer 707 and a center position of a drill bit 709 deviates from the target trajectory 701. There is a deviation $D_1$ between the center position of the drill bit 709 and the target trajectory 701, and there is a relationship between the deviation $D_1$, an azimuth angle $\theta_1$ of the deviation direction of the deviation $D_1$ (as shown in FIG. 15B), a controlled displacement $D_2$ of the drill string at the position of the active stabilizer 707, that is driven by the active stabilizer 707, an azimuth angle $\theta_2$ of the direction of the displacement $D_2$ (similar to $\theta_1$, not shown), and a measured vector lateral force F that may be caused by gravity, unsmooth well wall, and/or uniform formation. The relationship can be described by an exemplary mathematic model $[D_1, \theta_1]=f(D_2, \theta_2, F)$, which is built per the structure, dimension, material of the BHA. Based on the mathematic model, the deviation parameters $D_1$ and $\theta_1$ can be estimated from $D_2$, $\theta_2$, F.

Usually it is expected that the deviation $D_1=0$, such that the drill bit points forward along the desired trajectory. Thus, based on the mechanical model and the measured lateral force F, it can be estimated how much adjustment $\Delta d$ is needed for the displacement $D_2$. Then the estimated adjustment $\Delta d$ in displacement $D_2$ is decoupled into the actuator motions. Thus, by controlling the adjustment $\Delta d$, the drilling system can accurately adjust the deviation $D_1$ to an expected value, for example, zero, to follow the desired trajectory.

Figure 16:
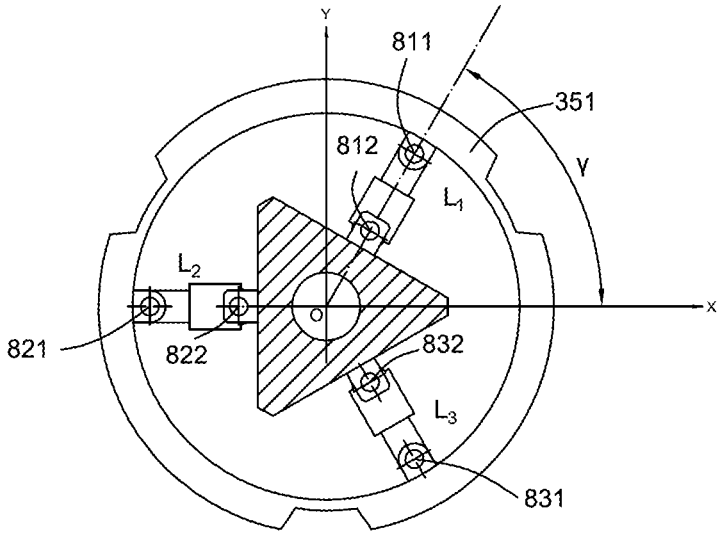
FIG. 16 is a schematic sectional view of an active stabilizer, for illustrating a relation between a displacement driven by the active stabilizer and motions of actuators of the active stabilizer.

The adjustment $\Delta d$ in displacement is converted into a x-component $\Delta x$ (along x-axis) and a y-displacement $\Delta y$ (along y-axis), and the Δx and Δy are decoupled into motions of three actuators (for example, motions of three pistons) by:

$$\begin{cases} L_1 = \sqrt{(\Delta x - R\cos(\gamma))^2 + (\Delta y - R\sin(\gamma))^2} \\ L_2 = \sqrt{(\Delta x - R\cos(\gamma + 120^\circ))^2 + (\Delta y - R\sin(\gamma + 120^\circ))^2} \\ L_3 = \sqrt{(\Delta x - R\cos(\gamma + 240^\circ))^2 + (\Delta y - R\sin(\gamma + 240^\circ))^2} \end{cases}$$

where Δx is the x-component of the adjustment Δd in displacement, Δy is the y-component of the adjustment Δd in displacement, and as shown in FIG. 16, L1 is a distance from the center (O) of the drill string to a center of the joint 811, L2 is a distance from O to a center of the joint 821, L3 is a distance from O to a center of the joint 831, and y is an azimuth angle of the joint 811.

Like the center O joint 812 also moves with (Δx, Δy). Thus, the length between joints 811 and 812, which defines the motion displacement of the first actuator, can be determined by a triangular defined by center O-joint 811-joint 812. Similarly, the motion displacements of the other two actuators also can be calculated. It means that the displacement of the drill string at the position of the active stabilizer is decoupled to the motions of the three actuators.

It should be noted that the imbalanced force control as described herein may not be intend to remove the imbalanced force/bending, but to reduce the unexpected deviation of the drill bit by taking the imbalanced force/bending into account in drilling trajectory control.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A steerable drilling system, comprising:

a rotatable drill string for connecting with a drill bit for drilling a borehole along a drilling trajectory;

an active stabilizer comprising:

a body having an outer surface for contacting a wall of the borehole; and a plurality of actuators connecting the body and the drill string, the plurality of actuators capable of driving the drill string to deviate away from a center of the borehole with a displacement to change a drilling direction;

a direction parameter measurement module for measuring direction parameters during the drilling, the direction parameters comprising at least one of an inclination angle and an azimuth angle of the borehole;

an imbalance parameter measurement module for measuring imbalance parameters during the drilling, the imbalance parameters comprising at least one of a lateral force, a bending moment and a torque at a measuring position near the drill bit; and a controller for controlling the drilling trajectory based on the measured direction and imbalance parameters, the controller comprising a calculator for calculating an adjustment needed for the displacement, based on the measured direction and imbalance parameters and expected values of these parameters.

2. The system according to claim 1, wherein the controller comprises a decoupler for decoupling the adjustment into expected motions of the plurality of actuators.

3. The system according to claim 1, wherein the imbalance parameter measurement module comprises a base section and at least one sensor in the base section.

4. The system according to claim 3, wherein the base section is between the drill bit and the active stabilizer and comprises an annular structure having opposite first and second axial end surfaces, and a cylindrical side surface extending between the first and second axial end surfaces and defining at least one sensing chamber for accommodating the at least one sensor, the sensing chamber opening onto at least one of the axial end surfaces.

5. The system according to claim 3, wherein the at least one sensor comprises at least one strain gauge group, each group comprising a first strain gauge, and a second gauge and a third gauge inclined at substantially equal angles to the first strain gauge, and wherein the imbalance parameters comprise a three dimensional force, a three dimensional bending moment and a torque measured by the at least one strain gauge group.

6. The system according to claim 5, wherein the at least one sensor comprises a three dimensional accelerometer, and wherein the imbalance parameters comprise a vibration amplitude, a vibration frequency and a vibration direction of the drill bit measured by the three dimensional accelerometer.

7. The system according to claim 1, wherein the expected values of the direction and imbalance parameters are estimated to compensate a deviation of the drill bit due to the gravity or uneven formation.

8. The system according to claim 1, wherein the body of the active stabilizer comprises an inner surface facing the drill string, and at least one guiding portion projecting from the inner surface towards the drill string, wherein each guiding portion defines at least one groove, and the drill string comprises at least one sliding portion, each capable of sliding within one of the at least one groove defined in the body of the active stabilizer, to constrain relative movement between the drill string and the active stabilizer along an axial direction of the drill string and guide relative movement between the drill string and the active stabilizer along a radial direction substantially perpendicular to the axial direction of the drill string.

9. The system according to claim 1, wherein each of the actuators comprises a cylinder rotatably coupled to one of the drill string and the body of the active stabilizer and a piston rotatably coupled to the other of the drill string and the body of the active stabilizer, the piston movable within the cylinder.

10. The system according to claim 1, wherein each of the actuators comprises a first link element rotatably coupled to the body of the active stabilizer via a first joint, a second link element and a third link element rotatably coupled to the drill string via a second joint and a third joint, respectively, wherein the first, second and third link elements are connected via a fourth joint, and the third and fourth joints are movable towards each other or away from each other.

11. A steerable drilling method, comprising:

drilling a borehole along a drilling trajectory with a drill bit connected to a rotatable drill string, the rotatable drill string coupled with an active stabilizer for driving the drill string to deviate away from a center of the borehole with a displacement to changing a drilling direction;

measuring direction parameters during the drilling, the direction parameters comprising at least one of an inclination angle and an azimuth angle of the borehole;

measuring imbalance parameters during the drilling, the imbalance parameters comprising at least one of a lateral force, a bending moment and a torque at a measuring position near the drill bit; and controlling the drilling trajectory based on the measured direction and imbalance parameters, comprising:

calculating an adjustment needed for the displacement, based on the measured direction and imbalance parameters and expected values of these parameters; and driving a plurality of actuators to move to achieve the adjustment.

12. The method according to claim 11, wherein driving the plurality of actuators to move to achieve the adjustment comprises: decoupling the adjustment into expected motions of the plurality of actuators, and driving the plurality of actuators to make the expected motions.

13. The method according to claim 11, wherein measuring imbalance parameters comprises measuring at least one of a three dimensional force, a three dimensional bending moment, and a torque at the measuring position by at least one sensor, the at least one sensor comprising at least one strain gauge group, each group comprising a first strain gauge, and a second gauge and a third gauge inclined at substantially equal angles to the first strain gauge.

14. The method according to claim 13, wherein measuring imbalance parameters comprises measuring a vibration amplitude, a vibration frequency and a vibration direction of the drill bit by a three dimensional accelerometer.

15. The method according to claim 11, wherein the expected values of the direction and imbalance parameters are estimated to compensate a deviation of the drill bit due to the gravity or uneven formation.

* * * * *